US005160129A

United States Patent [19]

Siriporn et al.

[11] Patent Number: 5,160,129

[45] Date of Patent: Nov. 3, 1992

[54] SHEET STACKING

[75] Inventors: Charn Siriporn, Bel Air; Charles S. Milcarek, Jr., Timonium; Ronald J. Norman, Parkton, all of Md.; Randon L. Baum, York, Pa.; Michael G. Holecek, Sparks, Md.

[73] Assignee: Ward Holding Company, Inc., Wilmington, Del.

[21] Appl. No.: 750,499

[22] Filed: Aug. 27, 1991

[51] Int. Cl.[5] ..... B65H 29/40

[52] U.S. Cl. ..... 271/178; 271/215; 271/218; 414/789.1; 414/907

[58] Field of Search ..... 271/214, 215, 217, 218, 271/219, 223, 224, 178; 414/907, 789.1, 794.8

[56] References Cited

U.S. PATENT DOCUMENTS

| | | | |
|---|---|---|---|
| 2,789,704 | 4/1957 | Lewin . | |
| 3,095,192 | 6/1963 | Simjian . | |
| 3,712,186 | 1/1973 | Lulie et al. . | |
| 3,892,168 | 7/1975 | Grobman . | |
| 3,971,554 | 7/1976 | Stange | 271/217 |
| 4,019,730 | 4/1977 | Staudinger et al. | 271/214 |
| 4,500,243 | 2/1985 | Ward, Jr. et al. . | |
| 4,591,142 | 5/1986 | Divoux et al. | 271/214 |
| 4,632,378 | 12/1986 | Sardella . | |
| 4,687,193 | 8/1987 | Scarabino et al. | 271/217 |
| 4,718,807 | 1/1988 | Baxter . | |

FOREIGN PATENT DOCUMENTS

| | | |
|---|---|---|
| 0173959 | 12/1986 | European Pat. Off. . |
| 1561965 | 3/1980 | United Kingdom . |

*Primary Examiner*—H. Grant Skaggs

*Attorney, Agent, or Firm*—Boyce C. Dent; Edward D. C. Bartlett

[57] ABSTRACT

A sheet stacker, particularly for corrugated paperboard container blanks, has a downwardly movable elevator for supporting stacked sheets, firing rollers for feeding successive sheets in a path above the elevator, and a stop for stopping each successively fed sheet above the elevator and enabling each stopped sheet to drop onto a stack being formed. A flexible cam, preferably a resiliently flexible loop, is rotatably mounted above the elevator. The flexible cam is intermittently rotated to move the cam out of the path of a sheet being fed to allow a leading portion of this fed sheet to pass under the flexible cam, then to bring the cam into contact with a rear portion of the fed sheet to urge this rear portion towards the stack, and then to bring the flexible cam to rest in kissing contact with the fed sheet when resting on top of the stack being formed. Tolerance variations in the sheet thickness can be accommodated by flexing of the cam.

25 Claims, 7 Drawing Sheets

SHEET STACKING

FIELD OF INVENTION

This invention relates to stacking sheets, particularly sheets in the form of container blanks, including folded and glued container blanks of corrugated paperboard.

BACKGROUND OF THE INVENTION

Corrugated paperboard sheets may be formed into stacks by being stopped and then allowed to drop onto a descending elevator. Tines may be moved through the board line to temporarily support a newly forming stack while a fully formed stack is lowered further on the elevator and then ejected to a discharge conveyor. Apparatus for so forming such stacks is disclosed in U.S. Pat. No. 4,500,243 and U.S. Pat. No. 4,632,378. These are examples of so called die-cut stackers.

When making corrugated paperboard container blanks, printed and creased/slotted blanks may have two flaps folded over and glued together. These folded and glued blanks are then stacked for shipment or storage. This stacking is usually performed immediately after the folded and glued blanks leave a folder-gluer machine and while the glue has not properly dried or set. Stacking of these glued blanks is usually performed on so called counter ejectors.

As stacking speeds increase, it becomes more important to ensure in both die-cut stackers and counter ejectors that the leading edge of a following sheet does not get underneath the trailing edge of the sheet in front during the stacking procedure.

Also, particularly with counter ejectors where the freshly glued flaps tend to unfold and come apart, it is desirable to control the top of a stack while being formed and when fully formed. This presents new problems as stacking speeds increase, particularly with corrugated paperboard sheets which can readily be damaged by crushing.

SUMMARY OF THE INVENTION

The present invention is concerned with improving the stacking of sheets, particularly corrugated paperboard sheets which can be damaged by crushing.

A feature by which this is achieved by the present invention is the employment of a cam, including a row of cams, which is resiliently flexible, to contact the sheets; the preferred embodiment of such flexible cam is a smoothly and gently curved resiliently flexible loop. This has the advantage of flexing to accommodate tolerance variations in the sheet thickness. It also has the advantage of minimizing risk of damage to the surface of corrugated paperboard sheets.

According to one aspect of the invention, there is provided an apparatus for stacking sheets comprising an elevator for supporting stacked sheets, means for feeding successive sheets in a path above the elevator, means for moving the elevator downwards, and means for stopping each successively fed sheet above the elevator and enabling each stopped sheet to drop onto a stack being formed. Means are preferably provided for sensing the approach of each sheet as it approaches towards the stopping means and producing a signal in response thereto. A flexible cam is rotatably mounted above the elevator downstream of the feeding means, the flexible cam comprising a resiliently flexible loop extending from a member rotatable about an axis, this loop defining a plane transverse to the axis. Means are provided for rotating the flexible cam about the axis. Control means are provided for intermittently actuating the rotating means in response to the signal to rotate the flexible cam out of the path of a sheet being fed by the feeding means to allow a leading portion of this fed sheet to pass under the flexible cam, then to bring the flexible cam into contact with a rear portion of the fed sheet to urge the rear portion towards the stack, and then to bring the flexible cam to rest in kissing contact with the fed sheet when resting on top of the stack being formed.

Preferably, a plurality of flexible cams are mounted spaced apart on a rotatable shaft and the rotating means comprises an electric motor drivingly connected to this rotatable shaft.

The control means may comprise a computer.

The rotating means may have control circuitry for measuring torque associated with rotating the flexible cam out of contact with the sheet resting on top of the stack being formed, and the control means preferably controls the elevator moving means in accordance with the torque measured by this control circuitry.

A plurality of tines may be provided for temporarily supporting a newly forming stack of sheets when a stack has been formed on the elevator. Follow-down members can be associated with these tines and movable downwardly away from and upwardly towards the tines. Means may be provided for moving the follow-down members downwardly away from the tines to contact the top of the stack formed on the elevator, and for causing the follow-down members to move downwardly with the formed stack away from the tines while the elevator is moving downwards.

According to another aspect of the invention, there is provided an apparatus for stacking sheets comprising an elevator for supporting stacked sheets, means for feeding successive sheets forwardly in a path above the elevator, means for moving the elevator downwards, means for arresting forward motion of each successively fed sheet in the path and causing each so arrested sheet to drop onto a stack being formed, means for sensing each sheet as it moves towards the arresting means and for producing a signal in response thereto, a flexible cam mounted above the elevator and in the path, the flexible cam comprising a resiliently flexible loop rotatable eccentrically about an axis, means for rotating the flexible cam about the axis, and control means for actuating the rotating means in response to the signal to rotate the flexible cam out of the path of a sheet being fed by the feeding means to allow a leading portion of this fed sheet to pass under said cam, and then to further rotate the flexible cam to bring the flexible cam into contact with a rear portion of the fed sheet to urge the rear portion downwardly towards the stack.

According to yet another aspect of the present invention, there is provided an apparatus for stacking corrugated paperboard sheets comprising an elevator, means for moving the elevator downwards, means for feeding successive sheets in a path above the elevator, means for stopping each successively fed sheet above the elevator and enabling each stopped sheet to locate on top of a stack being formed above the elevator, a cam rotatable about an axis above the elevator, the cam comprising a resiliently flexible member extending transversely with respect to the axis, and means for rotating the cam about the axis. Control means are provided for coordinating operation of the rotating means and the moving means to rotate the cam out of the path of a sheet being fed by the feeding means, and to bring the cam to rest in kissing contact with the fed sheet when resting on top of the stack being formed, the cam resiliently flexing to compensate for any tolerance variations in the corrugated paperboard sheets and the downwards moving of the elevator to avoid crushing damage to the corrugated paperboard sheets.

According to yet a further aspect of the present invention, there is provided a method of stacking corrugated paperboard container blanks comprising the steps of feeding successive blanks in a path above a downwardly moving elevator, stopping each successively fed blank above the elevator and allowing each stopped blank to drop onto a stack being formed on the elevator, disposing a resiliently flexible cam at rest above the elevator and in the path, rotating the flexible cam from rest out of the path of each fed blank before such blank is stopped and allowing such blank to pass under the flexible cam, and bringing the flexible cam to rest in kissing contact with such blank when such blank has been stopped and is resting on top of the stack being formed.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings, in which like reference characters in the same or different Figures indicate like parts.

DETAILED DESCRIPTION OF THE PREFERRED EMBODIMENT

The preferred embodiment of the present invention is a counter ejector for stacking corrugated paperboard container blanks having folded and glued together flaps, this preferred embodiment being shown in FIGS. 1 to 7. FIG. 8 illustrates another embodiment of part of the present invention.

Figure 1:
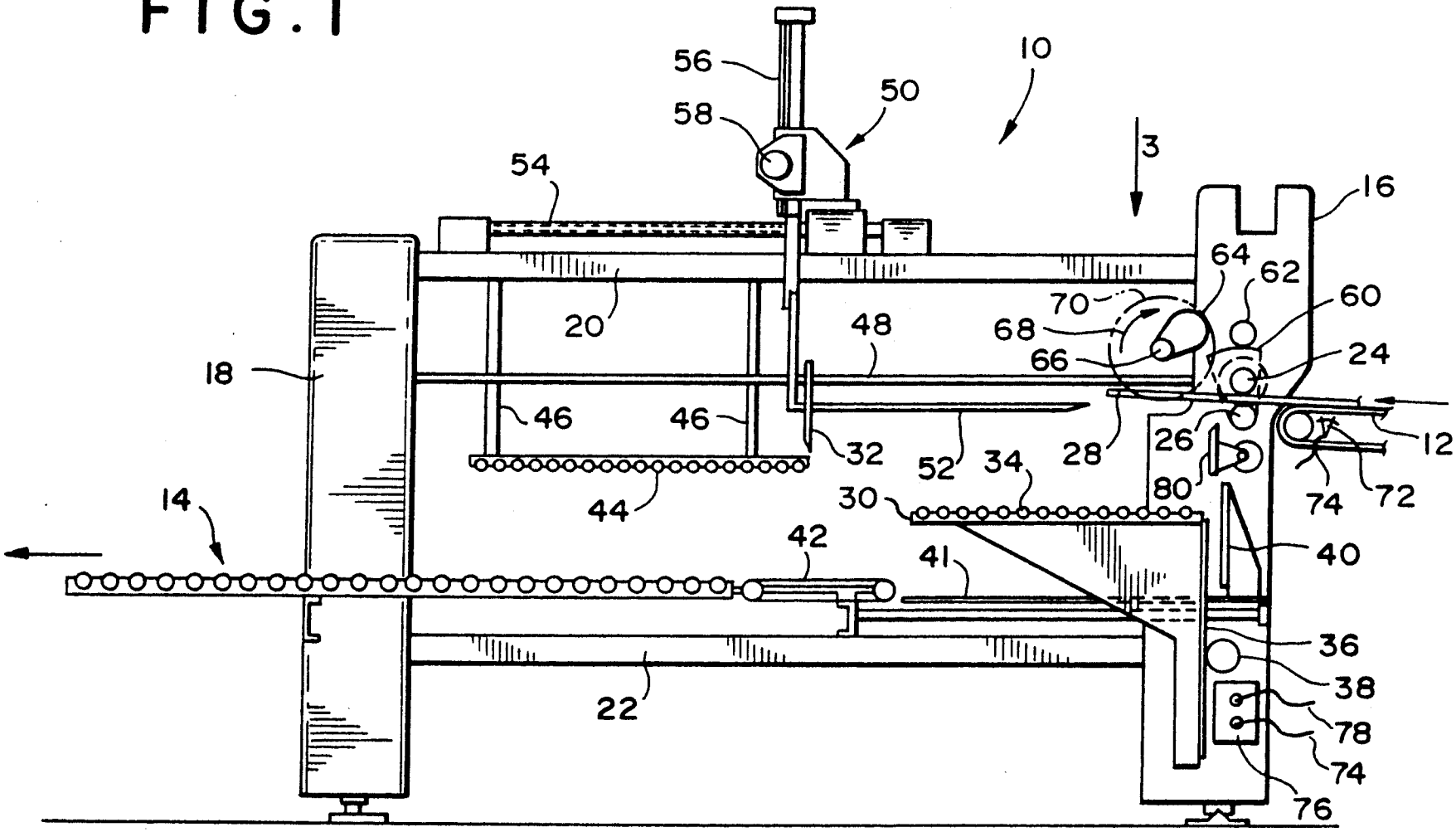
FIG. 1 is a diagrammatic, simplified side elevation of a sheet stacking apparatus according to the invention.

FIG. 1 shows in side elevation the general layout of the preferred counter ejector 10. An upwardly inclined, endless belt vacuum conveyor 12 feeds sheets to be stacked from a previous processing machine, for example a folding and gluing machine. The stacks of sheets formed are discharged from the counter ejector 10 on a discharge roller conveyor 14. The counter ejector 10 has a rear frame 16, a forward frame 18, and a plurality of connecting frame members 20, 22. A pair of firing rolls 24, 26 engage therebetween each sheet 28 as it reaches the discharge end of the conveyor 12, the firing rolls 24, 26 ejecting the gripped sheet 28 in a slightly upwardly inclined direction in a path over an elevator 30. The sheet 28 is so ejected at a speed three to five percent faster than the feeding conveyor 12, and the sheet comes to rest in the forward direction when it strikes a stop 32, the sheet then falling onto a stack forming on or above the elevator 30. As the stack forms, the elevator 30 moves continuously downwards via a rack 36 and pinion 38 drive. When a full stack is formed, the elevator continues downwardly to a bottom position in which rollers 34 forming the upper surface of the elevator 30 are aligned with the discharge conveyor 14; an ejector 40 then being moved along a guide 41 to eject the stack from the elevator 30 onto an intermediate belt conveyor 42 which runs at the same speed as the ejector 40. The ejected stack then leaves the counter ejector 10 on the discharge roller conveyor 14. Above the conveyors 42, 14, and immediately forward of the stop 32, is a top compression conveyor 44 suspended on adjustable supports 46 for engaging the top of the ejected stack and applying a small compression pressure thereto. To accommodate different length sheets 28, the plate-like stop 32 is adjustably mounted on a longitudinally extending screw 48, the stop 32 in FIG. 1 being shown adjusted fully forward to accommodate the largest sheet. A tine assembly 50, which in accordance with the invention also incorporates stack follow-down members, has a plurality of forwardly extending tines 52 and is mounted on a horizontal rack 54 for movement horizontally; and the tines 52 are also movable vertically by means of a rack 56 and pinion 58 mechanism. By way of example, the tines 52 are shown just below the board line of entering sheets, and so are shown in a position in which a new stack of sheets would start to form on the tines 52.

The lower firing roll 26 is fixed in location, but the upper firing roll 24 is mounted on a gear segment 60 which is adjustably rotatable a few degrees about the rotational axis of the lower roll 26 by a pinion 62 which drivingly meshes with gear teeth of the gear sector 60. By adjustable rotation of the gear pinion 62 a few degrees, the upwardly inclined firing angle of the rolls 24, 25 can be adjusted through a small range from zero degrees (i.e. horizontal) to ten degrees, the setting for folded and glued corrugated paperboard blanks being about five degrees. Just forwardly, i.e. downstream of the firing rolls 24, 26, is a flexible cam 64 rotatable by a shaft 66 in the direction of the arrow 68, a full rotation of the outer extremity of the flexible 64 being indicated by a broken-line circle 70. Normally, the flexible cam 64 is disposed vertically downwardly and intersects the path of travel of the sheets 28. However, each approaching sheet 28 is sensed by a photocell sensor 72 at the end of the feed conveyor 12 just upstream of the firing rolls 24, 26; this sensing of the next approaching sheet is transmitted as a signal via wiring 74 from the sensor 72 to a computer control unit 76 which in turn transmits a signal by wiring 78 to cause the flexible cam 64 to be rapidly rotated in the direction of the arrow 68 out of the path of the oncoming sheet just before the leading edge of this oncoming sheet reaches the location of the flexible cam 64. The sheet 28 then passes unhindered below the raised flexible cam 64 as shown in FIG. 1. Rotation of the flexible cam 64 is continued and timed by the computer 76 so that it strikes the rear portion of the sheet 28 passing below so knocking the rear end of the sheet downwardly towards the stack being formed above the elevator 30. The flexible cam then comes to rest in its vertically lowermost position in which it is arranged to be in kissing contact with the top of the forming stack, i.e. in very light contact with the sheet that has just fallen onto the top of the stack. With folded and glued container blanks, the glue may not have fully set, and the glued flaps have a tendency to want to unfold. The function of the flexible cam 64 is primarily not to apply pressure to the top of the stack, but to prevent any unfolding of the freshly glued flaps.

A spanker mechanism 80 continuously spanks the rear of the forming stack to provide a neatly aligned stack as is well known.

The general mounting and adjustment arrangement for the flexible cam 64 will now be described with reference to FIGS. 2 and 3, and the flexible cam itself will be described in greater detail with reference to FIG. 4.

Figure 2:
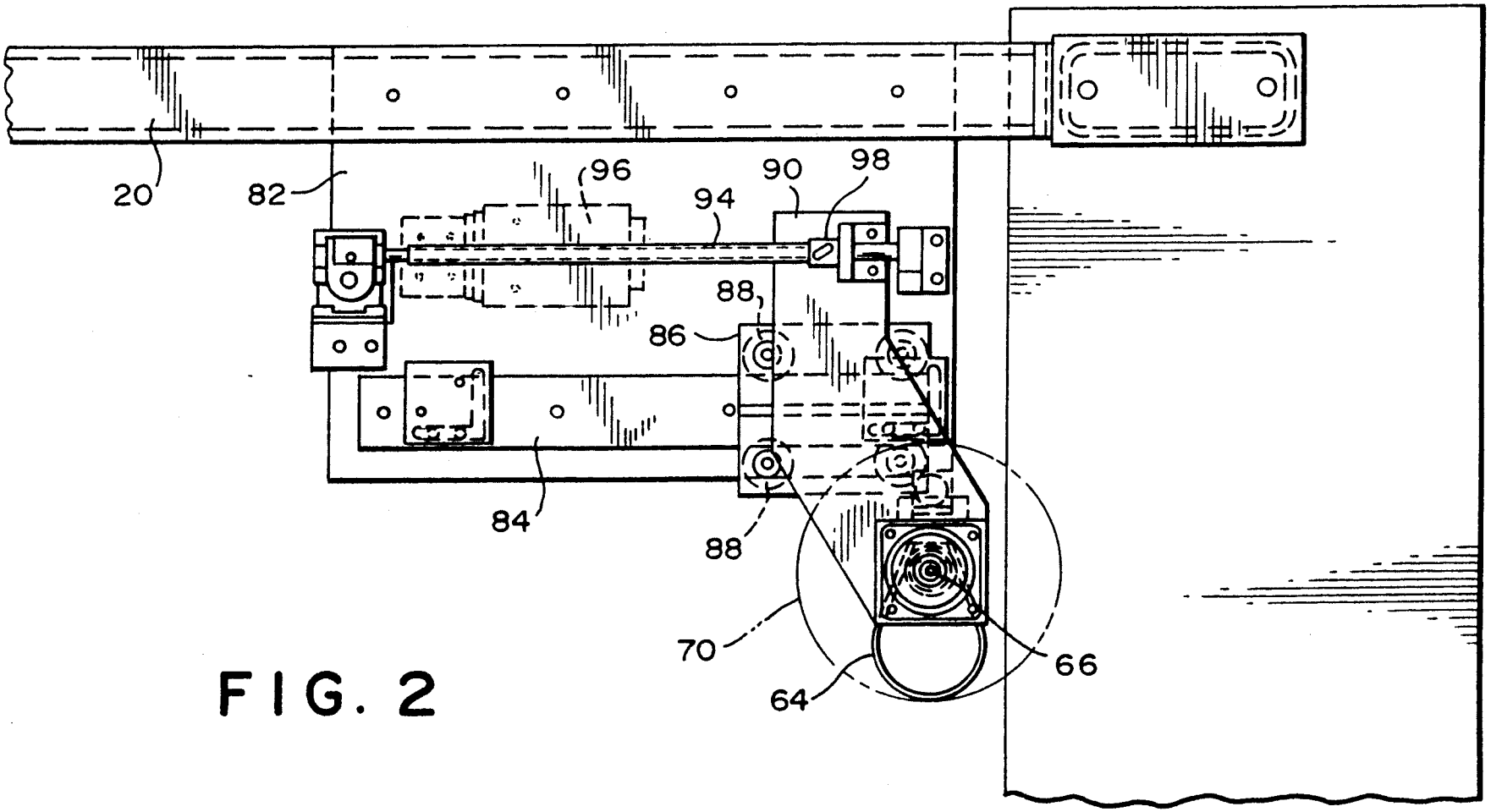
FIG. 2 is a portion of FIG. 1 shown in greater detail illustrating the supporting arrangement for a flexible cam.

FIG. 2 shows a plate 82 suspended from the horizontal frame member 20. A horizontally extending track 84 is mounted on the outside surface of the plate 82 adjacent its lower edge. A movable carriage 86 is movably mounted via four wheels 88 on the track 84. A vertical plate 90 is secured on an outer face of the carriage 86, and one end of the flexible cam shaft 66 is journalled in a lower portion of the plate 90. An elongate screw 94 is rotatably mounted on the plate 82 and connected via bevel gearing to be drivenly rotated by an electric motor 96. A screw follower 98 is mounted at the upper end of the plate 90 and the screw 94 drivingly engages through the screw follower 98 allowing the longitudinal position of the plate 90 along the plate 82 to be adjusted by rotation of the screw 94 by the motor 96.

Figure 3:
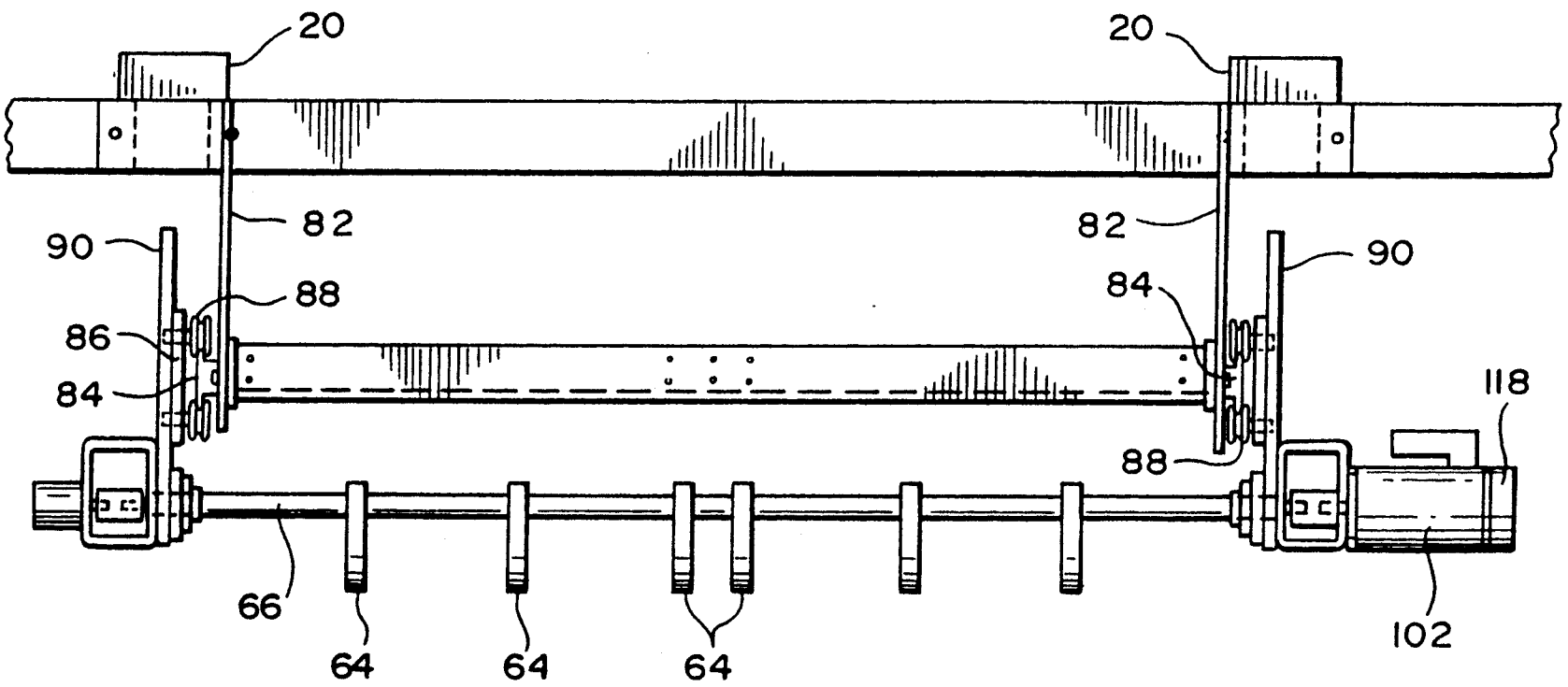
FIG. 3 is a top plan view in the direction of the arrow 3 in FIG. 1 of part of the apparatus showing further details of the mounting arrangement of six flexible cams.

FIG. 3 shows that there is a suspended plate 82 on each side of the stacking apparatus, each plate 82 carrying a respective track 84 with a carriage 86 movably mounted thereon and having a plate 90. Both plates 90 are simultaneously moved along the tracks 84 by the motor 96 via bevel gearing, the screw 94 in FIG. 2, and a similar screw 94 on the other side of the stacking apparatus. For rigidity the two suspended plates 82 are connected by a cross beam 100. As can be clearly seen in FIG. 3, six flexible cams 64 are spaced apart along the shaft 66 for simultaneous rotation therewith by an electric motor 102 drivingly connected to one end of the shaft 66. In FIG. 3 the flexible cams 64 are approximately in the same orientation as shown in FIG. 1, this being approximately 270 degrees rotationally displaced from the normal stationary orientation shown in FIG. 2.

Figure 4:
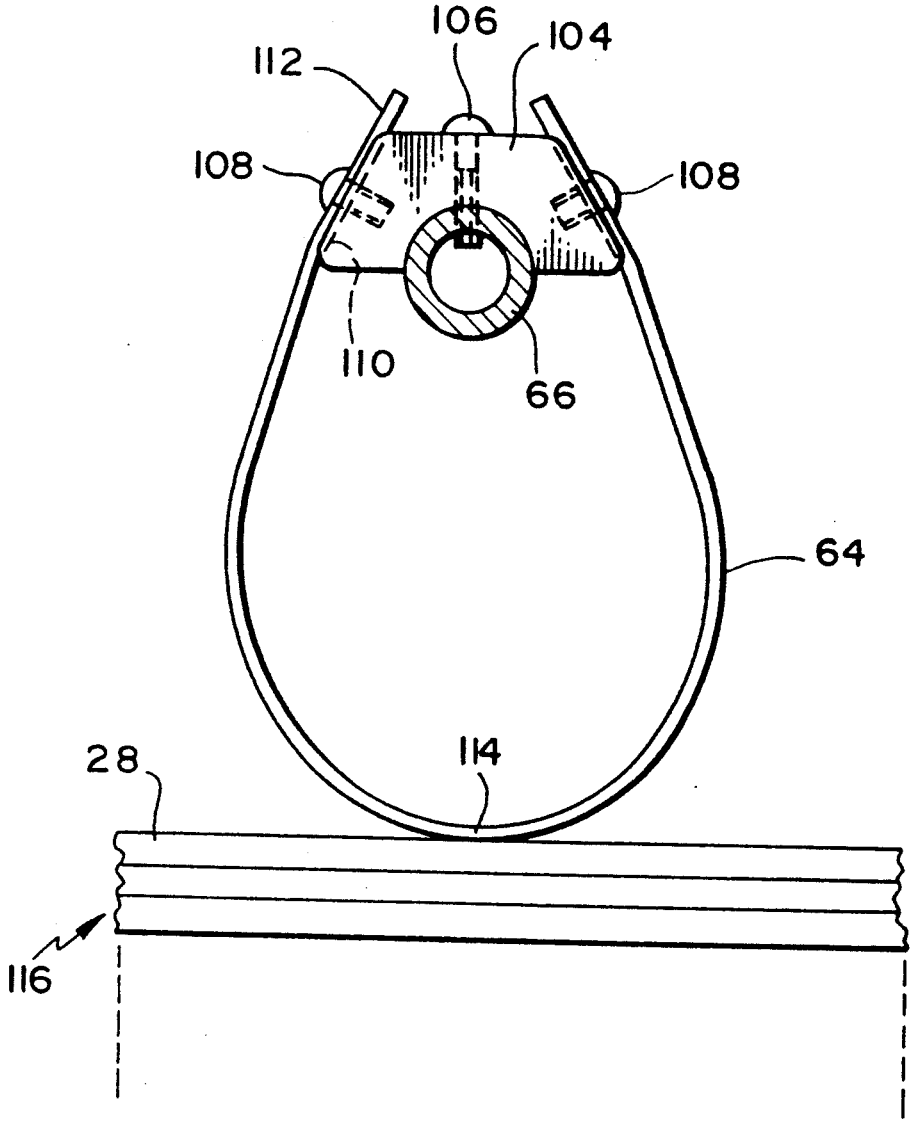
FIG. 4 shows the flexible cam of FIG. 2 in greater detail and in contact with the top of a stack of sheets being formed.

FIG. 4 shows on a larger scale the flexible cam 64 which is made up of a flexible strip bent into a resilient loop of somewhat pear-shape form with the free ends 112 of the strip secured by screws 108 in channels 110 of a yoke member 104. The yoke member 104 fits over the shaft 66, which is hollow, and is secured to the shaft 66 by a screw 106 which is screwed through the wall of the shaft 66. The pear-shaped flexible cam 64 is disposed eccentrically with respect to the shaft 66 with the apogee of the cam 64 on the opposite side of the shaft 66 to the mounting yoke 104. In the situation shown in FIG. 4, the ejected sheet 28 in FIG. 1 has come to rest on top of the stack 116 being formed, and the flexible cam 64 has come to rest in its lowest position with its apogee in kissing contact with the upper surface of the now top sheet 28. The apogee 114 can resiliently flex upwardly to accommodate any tolerance variations in the thickness of the sheets in the stack 116 and also any tolerance variation in the speed of descent of the elevator 30, or the tines 52, upon which the forming stack is descending. The flexible cam 64 can conveniently be made from a strap having a length of 15.5 inches, a width of an inch and of thin thickness (an eighth of an inch thick with plastic material, but substantially less with spring steel). The apogee of the cam is 5.5 inches from the axis of rotation of the shaft 66, and the maximum diameter of the cam below the apogee is 4.75 inches. Although the strap of the flexible cam 64 could be of spring steel, best results have been obtained with plastic material, particularly an ultra high molecular weight polyethylene such as sold under the name "NYLATRON"; such a strap is not too soft to become damaged, not to brittle to shatter, does not tend to mark the surface of corrugated paperboard, and also minimizes smudging of any ink printing on the paperboard sheet.

As can be seen in FIG. 4, the apogee 114 of the flexible cam 64 is formed by a smooth, gentle curve which can slide over the upper sheet of the forming stack when the cam 64 is rotated. This reduces the frictional drag between the cam 64 and the top of the stack when the cam starts to rotate out of contact from the top of the stack. Also, this shape permits kissing contact with the top of the stack with only a light pressure of the apogee against the top of the stack, for example in the range of zero to five pounds pressure and preferably in the range of zero to two pounds pressure The flexible cam drive motor 102 (see FIG. 3) has a motor control circuit 118 which measures the torque of the motor 102 by the electric current being drawn. When the motor 102 starts to rotate the flexible cam 64 from the stationary position being shown in FIG. 4, the initial starting torque measured in the control circuitry 118 is fed back to the computer control unit 76 (FIG. 1) and compared with a pre-set value corresponding to the frictional drag caused by a pressure of two pounds or less of the flexible cam against the top of the forming stack. Should this initial torque of the motor 102 be greater than the pre-set value, then the computer control unit 76 makes an appropriate adjustment to the speed of descent of the elevator 30 by adjusting the rotational speed of drive of the pinion 38. If desired, a minimum pre-set value of the initial motor torque can be entered into the computer control unit 76, so that should the initial torque of the cam drive motor 102 be too low, the speed of descent of the elevator 30 can correspondingly be reduced.

The cam mounting shaft 66 is provided with a series of tapped holes along its length to provide for different axial mounting positions of the flexible cams 64. Also, more or less cams 64 can be provided for any particular stacking operation.

The cam drive motor 102 is controlled to accelerate the cam 64 from rest in the position shown in FIGS. 2 and 4 to a peak angular velocity at an intermediate rotational position (for example the position of the cam 64 shown in FIG. 1), and then decelerate the rotational velocity until the cam 64 comes to rest in the position shown in FIG. 4. The computer control unit 76 is programmed to determine the rate of acceleration, the peak rotational velocity, and the rate of deceleration so that the cams 64 rotate out of contact with the top sheet of the stack 116 just before they would otherwise be struck by the leading edge of the sheet in the process of being forwardly delivered by the firing rollers 24, 26. This control continuing so that the rotating cams 64 downwardly hit the rear portion of the sheet just projected by the firing rollers 24, 26, and then to cause the cams 64 to come to rest in the FIG. 4 position in kissing contact with the just projected sheet as soon as that sheet engages the top of the forming stack 116. Preferably, the cam mounting shaft 66 is positioned via the screw 94 rearwardly from the stop plate 32 by two thirds of the length of the particular sheets being stacked.

The tine assembly 50 (FIG. 1), including the stack follow-down members, will now be described in greater detail with respect to FIGS. 5 to 8.

Figure 5:
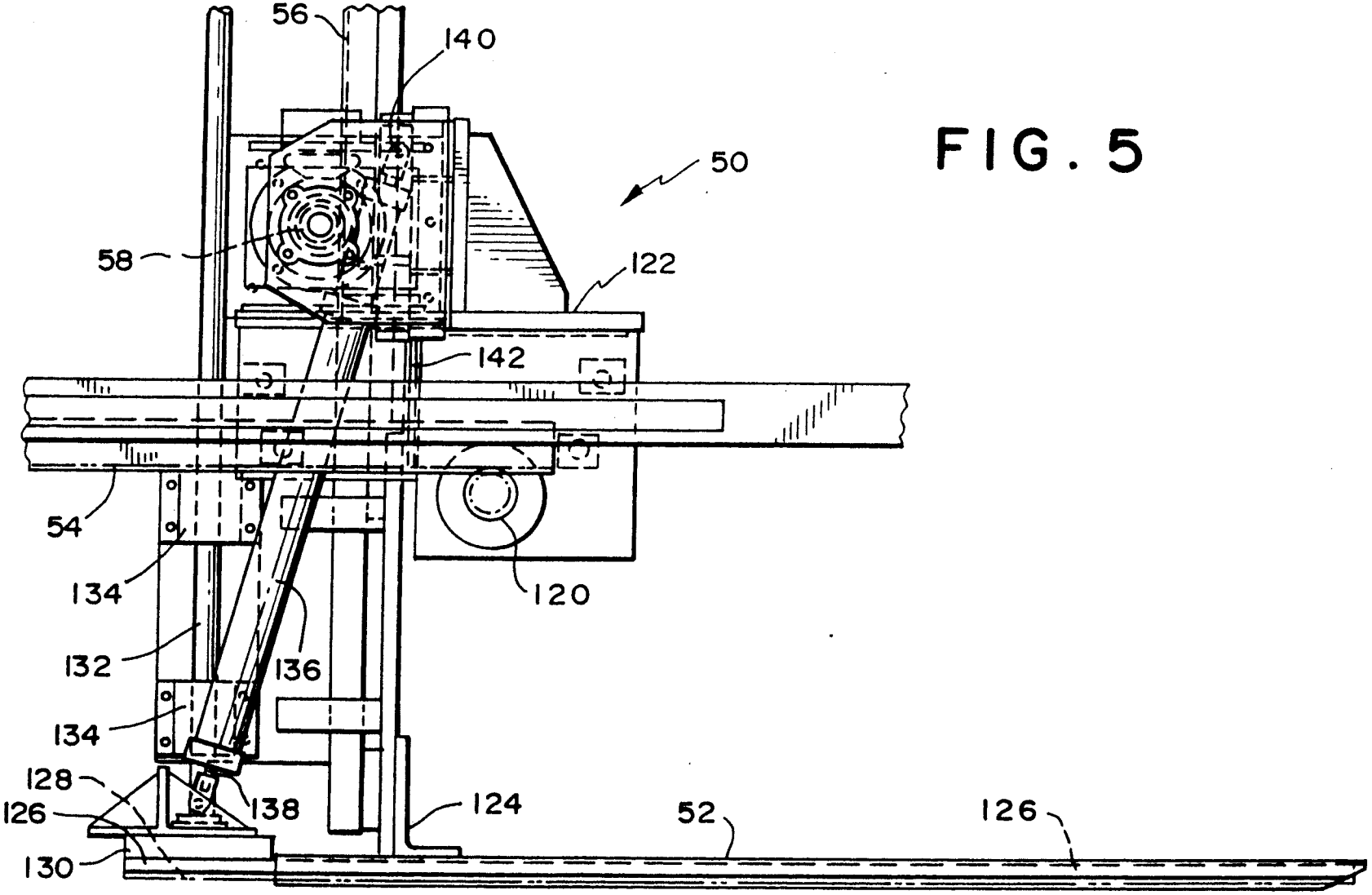
FIG. 5 shows a portion of FIG. 1 in greater detail and including tines for supporting a newly forming stack of sheets and members for following down on top of a fully formed stack of sheets.

FIG. 5 shows the tine assembly 50 having a mounting unit 122 having a pinion 120 drivable by an electric motor for moving the mounting unit 122 horizontally along the rack 54. The plurality of spaced apart tines 52 are disposed in a horizontal plane and attached adjacent their lefthand ends to the vertical rack 56 by a bracket 124 so that the tines 52 move upwardly and downwardly as the rack 56 is moved upwardly and downwardly by driving rotation of the pinion 58, the mounting unit 122 also supporting the pinion 58 and its drive. Each tine 52 is a hollow channel-like member of inverted U-shaped cross section so that the lower side of each tine 52 is open. Inside the channel section of each tine 52 is nested a rectangular cross sectioned follow-down member (which functions with folded and glued blanks as a flap stabilizer). Along the lower surface of each follow-down member 126 are mounted a plurality of small rollers 128 having their axes perpendicular to the plane of the paper of FIG. 5, i.e. the axes of the rollers 128 are parallel to the axes of the elevator rollers 34 in FIG. 1. When the follow-down members 126 are in the fully nested position shown in FIG. 5, each member 126 is contained within the respective tine 52 except for the lefthand ends of the members 126 which extend to the left in FIG. 5 of the lefthand ends of the tines 52. The lefthand ends of the plurality of members 126 are secured to a horizontal transverse beam 130 attached to the lower end of a vertical rod 132 slidable vertically in a pair of spaced apart brackets 134 supported by intermediary plates and brackets from the mounting unit 122. A two stage air cylinder 136 is connected by pivotal connections between the horizontal beam 130 and the mounting unit 122. Extension of the air cylinder 136 causes the rod 132 to move downwardly through the brackets 134 so causing the follow-down members 126 to move out of the tines 52 and then on downwardly below the tines 52. Movement of the air cylinder 136 is independent of vertical movement of the tines 52 by the pinion 58. However, the upper pivotal connection 140 of the air cylinder 136 is mounted on a vertical plate 142 which is supported on and secured to the vertically movable rack 56; consequently, there is no extension or retraction of the air cylinder 136 when the tines 52 move upwardly or downwardly while the follow-down members 126 remain nested inside the tines 52. The main cylinder of the two stage air cylinder 136 is preferably arranged so that once its piston 138 is released, it can slide downwardly out of the cylinder 136 under gravity, this allowing the follow-down members 126 to drop under gravity away from the tines 52 until the members 126 come to rest on top of any stack of sheets below supported on the elevator 30.

Figure 6:
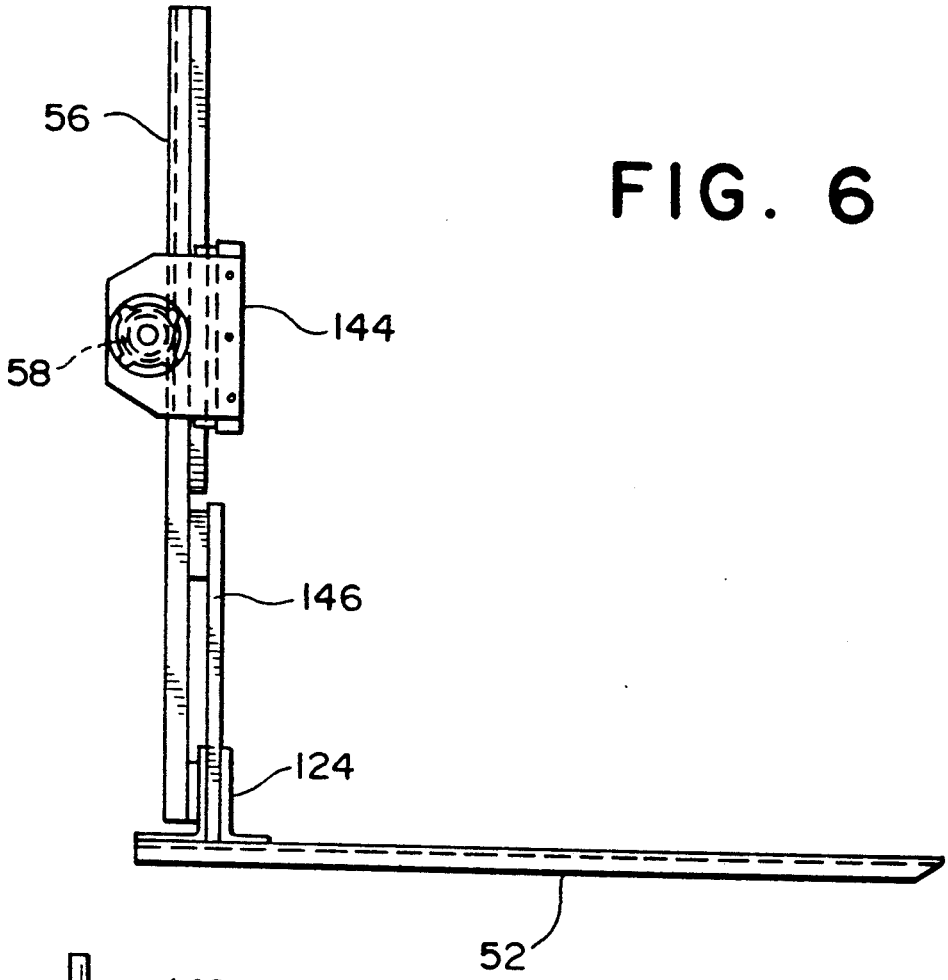
FIG. 6 illustrates a tine sub-assembly portion of FIG. 5.

FIG. 6 shows the tines 52 and their rack and pinion vertical drive 56, 58 separated out from the tine assembly 50 of FIG. 5. The driving pinion 58 is rotatably mounted in a housing 144 which, when assembled in the tine assembly 50, is bolted directly to an upstanding flange of the mounting unit 122 in FIG. 5. There is a rack 56, with its corresponding housing 144, disposed on each side of the stacker, with a horizontal shaft connecting the two driving pinions 58, and a vertical transverse plate 146 rigidly connecting the lower portions of both racks 56, the tine brackets 124 being secured to the lower part of the plate 146.

Figure 7:
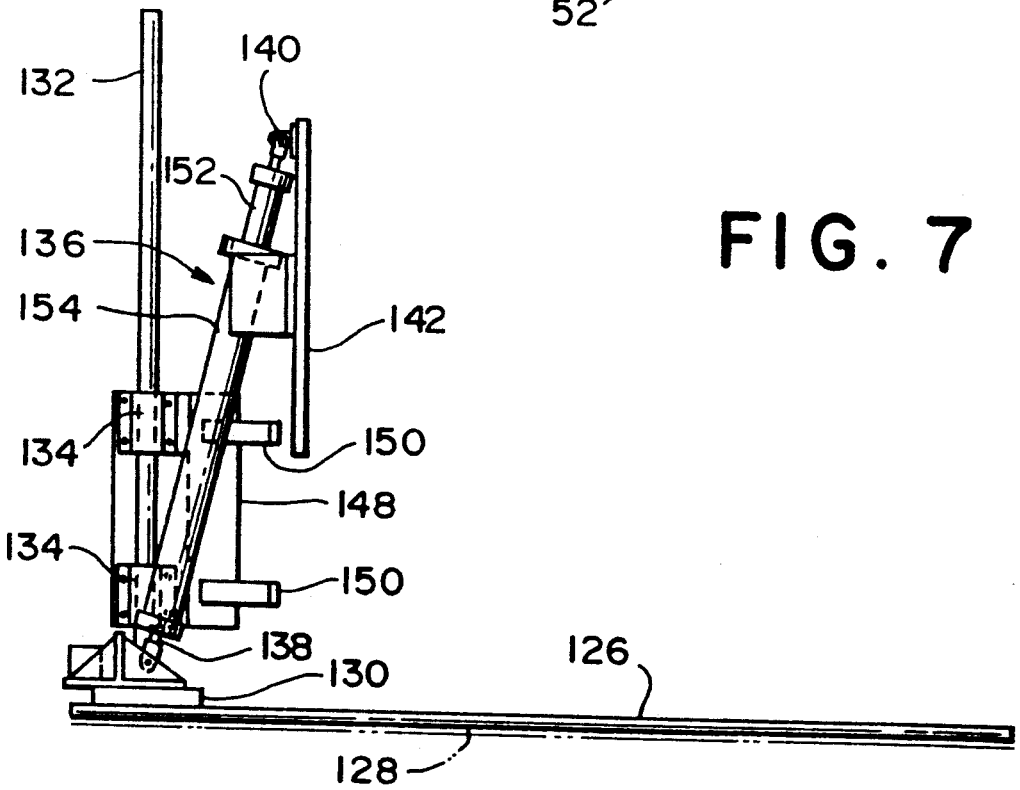
FIG. 7 illustrates a follow-down member sub-assembly portion of FIG. 5.
Figure 8:
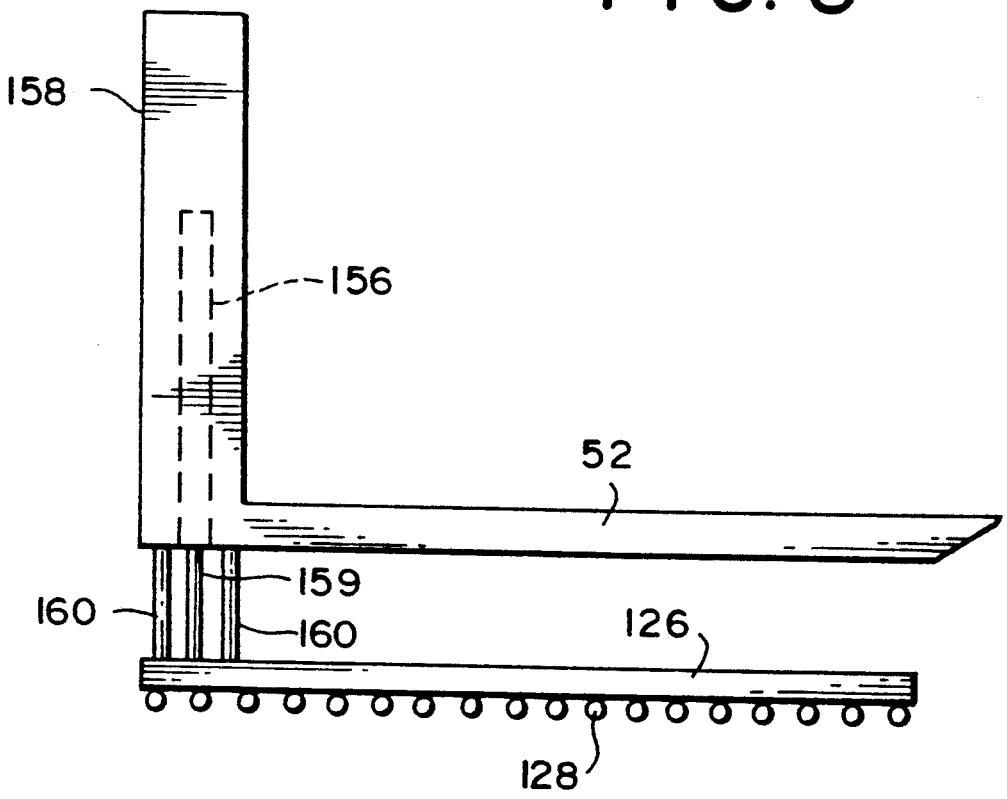
FIG. 8 illustrates a simplified diagrammatic view of a modified form of FIG. 5 with a stack follow-down member shown downwardly displaced from a stack support tine.

FIG. 7 shows the follow-down members 128, their guide mechanism and the actuating cylinder 136 separated from the tine assembly of FIG. 5. There are two vertical guide rods 132 spaced apart transversely along the common mounting plate 130, each guide rod 132 being vertically slidable in its own pair of brackets 134. Each pair of guide brackets 134 are mounted on a plate 148 having a pair of brackets 150 by which the plate 148 is secured directly to the transverse plate 146 (FIG. 6) connecting the two vertical racks 56. The plate 142, to which the upper end 140 of the double acting cylinder 136 is connected, is directly bolted to the upper central portion of the transverse plate 146 (FIG. 6). The double acting air cylinder 136 has a short cylinder 152 integral with the upper end of a long cylinder 154. The short air cylinder 152 is actuated to provide the initial downward movement of the follow-down members 126 out of and downwardly away from the tines 52, and then the long air cylinder 154 is actuated to allow the follow-down members 126 to continue thereafter to fall under gravity. When the follow-down members 126 are to be returned and again nested in the underside of the tines 52, the long air cylinder 136 first rapidly fully retracts its piston rod 138, and then the short air cylinder 152 draws the members 126 fully inside the tines 52.

FIG. 8 shows a simplified and modified version of the tine assembly 50 of FIG. 5. In this FIG. 8 embodiment, an air cylinder 156 is associated with an upright post 158 at the lefthand end of each tine 52. A piston rod 159 of the air cylinder 156 is connected at its lower end to an invididual follow-down member 126, there still being a plurality of follow-down members 126 spaced transversely across the stacker. Two guide rods 160 are slidably received within the post 158 and support at their lower ends the respective follow-down member 126. As before, the follow-down member 126 is supplied on its underside with freely rotatable rollers 128. Also, as before, when fully retracted upwardly, each follow-down member 126 nests fully inside the respective hollow tine 52. In FIG. 8, the follow-down member 126 is shown displaced out of its tine 52 and spaced a distance below the tine 52—it occupying such a position when engaging and following down with the top of a fully formed stack descending on the elevator 30 (FIG. 1).

In operation, at the start of building a stack of folded and glued corrugated paperboard container blanks, the tine assembly 50 is located in the position of FIG. 1, but with the tines 52 raised to just above the board line (at approximately the level of the longitudinal screw 48). Each flexible cam 64 is located in the position shown in FIG. 2 in the path of the oncoming container blanks. The container blanks are then successively conveyed from the gluer folder machine by the upwardly inclined vacuum conveyor 12, each blank 28 in turn being engaged by the firing rollers 24, 26 and projected upwardly at an inclination of 5 degrees to the horizontal on a path towards the stop 32. Just before each blank 28 reaches the flexible cams 64, the cams are rapidly rotated out of the way as in FIG. 1. Then, as the projected blank 28 is reaching the stop 32, the cams 64 descend to strike the trailing portion of the container blank and knock this trailing portion downward—this ensuring that the next succeeding blank will always pass over the top of the preceding container blank hitting the stop 32. The stopped blanks successively fall towards the elevator 30 and start to form a stack thereon. As the stack forms, the elevator 30 is steadily moved downwards by the pinion 38 driving the rack 36, the speed of elevator descent being controlled by the computer controller 76 in relation to initial input setup data, the rate of signals from the sensor 72, and input from the motor control circuit 118 concerning the resistance to rotation from rest of the flexible cams 64 caused by their engagement with the top sheet of the forming stack. When via the sensor 72 the computer 76 has counted the number of container blanks required to complete a stack, the tines 52 are lowered to the position shown in FIG. 1 just below the board line, and container blanks now commence to be stacked on the tines 52. At the same time, the short upper cylinder 152 rapidly moves the follow-down members 126 out from below the tines 52 to engage the top of the fully formed stack on the elevator 30. The elevator 30 continues downwardly to its bottom position level with the exit conveyors 42, 14, at the same time the follow-down members 126 falling under gravity and remaining resting on the top of the fully formed stack which supports their full weight; this weight of the follow-down members 126 is sufficient to prevent the newly glued flaps of the folded and glued container blanks from unfolding, but is not sufficient to crush or mark the corrugated paperboard of the container blanks. When the elevator 30 reaches its bottom position, the ejector 40 is actuated by an air cylinder to eject the full stack from between the rollers 34 of the elevator and the rollers 128 of the follow-down members 126, the ejected stack being forwarded by the fast conveyor 42 to the discharge roller conveyor 14. Thereupon, the ejector returns to its home position in FIG. 1, the compound air cylinder 136 causes a rapid ascent of the follow-down members 126 until they are again nested in the tines 52, and the elevator 30 ascends to just above the level of the tines 52. Thereupon, the pinion 120 is driven to retract the tine assembly 50 to the left in FIG. 1 until the pointed righthand ends of the tines 52 have passed to the left of the stop 32. The pinion 58 is then driven to raise the tines 52, together with the nested members 126, to just above the board line, at approximately the level of the screw 48 in FIG. 1; then the pinion 120 is again actuated to return the tine assembly 50 to the longitudinal position shown in FIG. 1 (but with the tines 52 above the board line). The partly formed stack so transferred onto the elevator 30 upon withdrawal of the tines 52, continues to build to a fully formed stack, and then the above procedure is repeated.

The top of the forming stack 116 is controlled, via the computer unit 76, to remain just below the nip of the firing rollers 24, 26. The radius of the apogee 114 of each flexible cam 64 is such as to provide a gentle curved section at the end of the pear-shaped loop to minimizes damage to the container blanks when resting thereagainst as in FIG. 4; and also to add to the controlled flexibility of the loop of the flexible cam 64 to allow controlled resilient yieldability to accommodate any variation in the thickness of the corrugated paperboard of the blanks, in the thickness of the folded and glued blanks, and in the speed of descent of the elevator.

As will be appreciated, while the stack is forming, the flexible cams in their rest position of FIGS. 2 and 4 prevent the freshly glued flaps from unfolding, but without applying any noticeable compression force to the stack being formed.

Also, the follow-down members by staying in contact with the top of the fully formed and descending stack, further control unfolding of the glued flaps By employing aluminum follow-down members, and allowing them to descend by gravity under their own weight, each member may exert a downward force of just several pounds. By allowing the follow-down members to descend under gravity, they automatically match the downward speed of the elevator.

The above described embodiments, of course, are not to be construed as limiting the breadth of the present invention. Modifications, and other alternative constructions, will be apparent which are within the spirit and scope of the invention as defined in the appended claims.

For example, although the preferred embodiment of the invention has been described above as applied to a counter ejector, the flexible cam 64 could be incorporated in a die-cut stacker to forgivingly knock the rear portion of each die-cut blank downwardly and, if so arranged, to stabilize the top of the forming stack.

Also, instead of stopping the sheets with the stationary stop plate 32, the sheets could be moved over the elevator 30 on overhead vacuum conveyors and brought to rest by stopping these overhead conveyors.

What is claimed is:

1. Apparatus for stacking sheets, comprising:

an elevator for supporting stacked sheets;

means for feeding successive sheets in a path above said elevator;

means for moving said elevator downwards;

means for stopping each successively fed sheet above said elevator and enabling each stopped sheet to drop onto a stack being formed;

means for sensing the approach of each sheet as it approaches towards said stopping means and producing a signal in response thereto;

a flexible cam rotatably mounted above said elevator downstream of said feeding means, said flexible cam comprising a resiliently flexible loop extending from a member rotatable about an axis, said loop defining a plane transverse to said axis;

means for rotating said flexible cam about said axis; and control means for intermittently actuating said rotating means in response to said signal:

(a) to rotate said flexible cam out of the path of a sheet being fed by said feeding means to allow a leading portion of this fed sheet to pass under said flexible cam, then (b) to bring said flexible cam into contact with a rear portion of the fed sheet to urge said rear portion towards said stack, and then (c) to bring said flexible cam to rest in kissing contact with said fed sheet when resting on top of the stack being formed.

2. The apparatus of claim 1, wherein said feeding means comprises a pair of firing rolls having parallel axes of rotation, one of these axes being arcuately adjustable with respect to the other of these axes to enable sheets to be projected upwardly and forwardly at an acute angle to the horizontal, said acute angle being adjustable by adjusting the arcuate position of said one axis.

3. The apparatus of claim 1, wherein said moving means comprises a rack and pinion mechanism.

4. The apparatus of claim 1, wherein said stopping means comprises a stationary plate.

5. The apparatus of claim 1, wherein a plurality of flexible cams are mounted spaced apart on a rotatable shaft and said rotating means comprises an electric motor drivingly connected to said rotatable shaft.

6. The apparatus of claim 1, wherein said control means comprises a computer.

7. The apparatus of claim 1, wherein said rotating means has control circuitry for measuring torque associated with rotating said flexible cam out of contact with the sheet resting on top of the stack being formed, and said control means controls said elevator moving means in accordance with the torque measured by said control circuitry.

8. The apparatus of claim 1, wherein said loop is pear-shaped.

9. The apparatus of claim 8, wherein said loop is formed by a flexed strip of plastic material, the strip being attached adjacent its ends to a member mounted on a shaft.

10. The apparatus of claim 1, including a plurality of tines for temporarily supporting a newly forming stack of sheets when a full stack has formed on said elevator, and wherein said sensing means has a second function in association with said control means of counting the number of sheets entering a stack being formed and causing said tines to be actuated to temporarily intercept further sheets when a predetermined number of sheets has been stacked on said elevator 11. The apparatus of claim 1, further comprising:

a plurality of tines for temporarily supporting a newly forming stack of sheets when a full stack has been formed on said elevator;

follow-down members associated with said tines and movable downwardly away from and upwardly towards said tines; and means for moving said follow-down members downwardly away from said tines to contact the top of the full stack formed on said elevator, and for causing said follow-down members to move downwardly with said full stack away from said tines while said elevator is moving said full stack downwards.

12. The apparatus of claim 11, wherein said moving means further functions to return said follow-down members upwardly to an inoperative position adjacent said tines.

13. The apparatus of claim 12, wherein said moving means comprises a unit having a first air cylinder for an initial rapid descent of said follow-down members, and a second air cylinder permitting said follow-down members to drop downwardly under gravity but be drivingly returned upwardly.

14. The apparatus of claim 11, wherein said follow-down members nest in said tines in an inoperative position of said follow-down members.

15. The apparatus of claim 11, wherein said follow-down members carry rollers protruding downwardly therefrom.

16. Apparatus for stacking sheets, comprising:

an elevator for supporting stacked sheets;

means for feeding successive sheets forwardly in a path above said elevator;

means for moving said elevator downwards;

means for arresting forward motion of each successively fed sheet in said path and causing each so arrested sheet to drop onto a stack being formed;

means for sensing each sheet as it moves towards said arresting means, and for producing a signal in response thereto;

a flexible cam mounted above said elevator and in said path, said flexible cam comprising a resiliently flexible loop rotatable eccentrically about an axis;

means for rotating said flexible cam about said axis; and control means for actuating said rotating means in response to said signal to rotate said flexible cam out of the path of a sheet being fed by said feeding means to allow a leading portion of this fed sheet to pass under said cam, and then to further rotate said flexible cam to bring said flexible cam into contact with a rear portion of the fed sheet to urge said rear portion downwardly towards said stack.

17. Apparatus for stacking corrugated paperboard sheets, comprising:

an elevator;

means for moving said elevator downwards;

means for feeding successive sheets in a path above said elevator;

means for stopping each successively fed sheet above said elevator and enabling each stopped sheet to locate on top of a stack being formed above said elevator;

a cam rotatable about an axis above said elevator, said cam comprising a resiliently flexible loop extending transversely with respect to said axis;

means for rotating said cam about said axis; and control means for coordinating operation of said rotating means and said moving means to rotate said cam out of the path of a sheet being fed by said feeding means, and to bring said cam to rest in kissing contact with said fed sheet when resting on top of the stack being formed, and the cam loop resiliently flexing to compensate for any tolerance variations in the corrugated paperboard sheets and the downwards moving of the elevator to avoid crushing damage to the corrugated paperboard sheets.

18. Apparatus for stacking folded and glued corrugated paperboard container blanks, comprising:

an elevator for supporting stacked sheets;

means for feeding successive blanks in a path above said elevator;

means for moving said elevator downwards;

means for stopping each successively fed blank above said elevator and enabling each stopped blank to drop onto a stack being formed;

a cam rotatable about an axis above said elevator and downstream of said feeding means, said cam having a rest position intercepting said path;

said cam comprising a resiliently flexible loop disposed eccentrically with respect to said axis, said loop extending transversely to said axis and being resiliently deformable towards said axis;

means for rotating said cam about said axis; and control means for controlling actuation of said rotating means to perform the following functions:

(a) rotate said flexible cam from said rest position out of the path of a blank being fed by said feeding means to allow a leading portion of this fed blank to pass under said flexible cam, and (b) stop said flexible cam in said rest position in contact with said fed blank when resting on top of the stack being formed.

19. A method of stacking corrugated paperboard container blanks, comprising the steps of:

feeding successive blanks in a path above a downwardly moving elevator;

stopping each successively fed blank above the elevator and allowing each stopped blank to drop onto a stack being formed on said elevator;

disposing a resiliently flexible cam at rest above said elevator and in said path;

rotating said flexible cam from rest out of the path of each fed blank before such blank is stopped and allowing such blank to pass under said flexible cam;

bringing said flexible cam to rest in kissing contact with such blank when such blank has been stopped and is resting on top of the stack being formed;

said elevator being moved downwardly at a substantially constant rate during formation of said stack; and adjusting said substantially constant rate of descent responsive to flexing of said cam by the top of said stack being formed.

20. The method of claim 19, wherein:

said flexible cam is rotatable eccentrically about an axis and is resiliently deformable towards the axis; and further comprising the step of:

bringing said flexible cam while rotating into contact with a rear portion of each fed blank to urge said rear portion towards the top of the stack.

21. A method of stacking sheets, comprising the steps of:

forming a vertical stack descending at a preselected substantially constant rate from sequentially advancing sheets with their leading edges in substantially vertical alignment;

contacting a trailing portion of a top sheet of said stack with a resiliently flexible cam to hold said trailing portion below the level of a leading edge of an approaching sheet to prevent interference therebetween as said approaching sheet advances towards a top of said stack;

releasing said trailing portion just prior to arrival of said approaching sheet so as not to impede the advance of said approaching sheet over and onto the top of said stack; and adjusting said pre-selected rate in response to flexing of said cam by the top sheet of said stack when the top of said stack exceeds a predetermined level.

22. The method of claim 21, wherein said cam comprises a resiliently flexible loop; and further comprising the step of eccentrically and intermittently rotating said loop about an axis above the top of said stack.

23. Apparatus for stacking sheets, comprising:

elevator means for receiving sequentially advancing sheets thereon in front edge alignment;

said elevator means being movable downwardly at a substantially constant rate of descent while a stack of said sheets is formed thereon;

flexible means above said stack for flexibly contacting and resiliently urging a trailing edge of each preceding sheet below a leading edge of each succeeding sheet to prevent interference therebetween, during formation of said stack on said elevator means; and said flexible means comprising are siliently deformable loop.

24. The apparatus of claim 23, wherein said sheets each have folded flap portions, said apparatus further including:

means for discharging said stack from said elevator means; and flap holding means responsive to formation of a completed stack of sheets on said elevator means for holding the flap portions of a top sheet of said completed stack in a folded closed position during discharge of said completed stack from said elevator means by said discharging means.

25. Apparatus for stacking sheets, comprising:

elevator means for receiving sequentially advancing sheets thereon in front edge alignment;

said elevator means being movable downwardly at a substantially constant rate of descent while a stack of said sheets is formed thereon;

flexible means above said stack for flexibly contacting and resiliently urging a trailing edge of each preceding sheet below a leading edge of each succeeding sheet to prevent interference therebetween, during formation of said stack on said elevator means; and said flexible means being responsive to the height of said stack being formed on said elevator means for adjusting said substantially constant rate of descent of said elevator means.

* * * * *